US006938377B2

(12) United States Patent
Gorman

(10) Patent No.: US 6,938,377 B2
(45) Date of Patent: Sep. 6, 2005

(54) DOUBLE HUNG WINDOW HAVING COMBINED PUSHDOWN SURFACE AND KEEPER

(75) Inventor: Christopher Gorman, Puyallup, WA (US)

(73) Assignee: Milgard Manufacturing Incorporated, Tacoma, WA (US)

( * ) Notice: Subject to any disclaimer, the term of this patent is extended or adjusted under 35 U.S.C. 154(b) by 7 days.

(21) Appl. No.: 10/646,562

(22) Filed: Aug. 21, 2003

(65) Prior Publication Data

US 2005/0039406 A1 Feb. 24, 2005

(51) Int. Cl.[7] ..... E05D 55/00
(52) U.S. Cl. ..... 49/449; 292/241
(58) Field of Search ..... 49/449; 292/241, 292/DIG. 20

(56) References Cited

U.S. PATENT DOCUMENTS 1,686,572 A * 10/1928 Polack ..... 292/241
1,901,974 A * 3/1933 Macy ..... 292/341.17
6,155,615 A * 12/2000 Schultz ..... 292/163
6,347,820 B2 * 2/2002 Subliskey ..... 292/346

FOREIGN PATENT DOCUMENTS

WO WO 94/18425 * 8/1994 ..... 49/449

* cited by examiner

*Primary Examiner*—Jerry Redman
(74) *Attorney, Agent, or Firm*—Carlson, Gaskey & Olds

(57) ABSTRACT

A double hung window is provided with a keeper on the upper pane that also provides an elongate surface for receiving a downward force for moving the upper pane. The keeper has a tongue provided on an inner side of a central web of the u-shaped member that forms the combined keeper and surface. The force-applying surface is provided on a vertically upper surface of the same central web. The force-applying surface is curved along a slight radius such that it comfortably accommodates the fingers of a user to provide the downward force.

10 Claims, 2 Drawing Sheets

DOUBLE HUNG WINDOW HAVING COMBINED PUSHDOWN SURFACE AND KEEPER

BACKGROUND OF THE INVENTION

This invention relates to a double hung window wherein the upper pane has a keeper for being secured to the lower pane, with the latch also providing a surface to assist in downward movement of the upper pane.

Double hung windows typically include an upper pane and a lower pane, with the two being movable vertically relative to each other. Typically, the upper pane is positioned outwardly of the window opening relative to the inner pane, such that the two may pass during this vertical movement. A pivoting latch is typically positioned on an upper surface of a frame of the lower pane. The latch pivots to lock underneath a keeper on a forward frame portion of the upper pane. When in the latched position, the two panes cannot be moved relative to each other. When the latch is pivoted to a release position, the upper and lower panes can move vertically relative to each other.

In some double hung windows, it is desirable and possible to move the upper pane vertically downwardly, and along side the lower pane. In the past, some surface on the upper pane has necessarily been used to apply a downward force. Users may have utilized a portion of the frame of the upper pane, or perhaps some additional surface may have been added to the upper pane. However, the portion of the upper pane including the "keeper" has typically had a shape that does not provide any such surface.

SUMMARY OF THE INVENTION

In a disclosed of this invention, a keeper is positioned on an upper pane of a double hung window. The keeper also has a force-applying surface for applying a downward force to the upper pane that extends along a distance that exceeds the length of the keeper tongue. In preferred embodiments, the keeper tongues extend for a length that is less than one-half the overall length of the force-applying surface. In most preferred embodiments, the keeper tongue extends for a length that is less than one-third the length of the force-applying surface.

In another preferred feature, the force-applying surface is curved to comfortably accommodate the user's fingers to apply the downward force. Thus, a vertically upward facing surface of the keeper is curved along a slight radius to provide a wide and comfortable surface for application of the downward force.

These and other features of the present invention can be best understood from the following specification and drawings, the following of which is a brief description.

DETAILED DESCRIPTION OF THE PREFERRED EMBODIMENT

Figure 1:
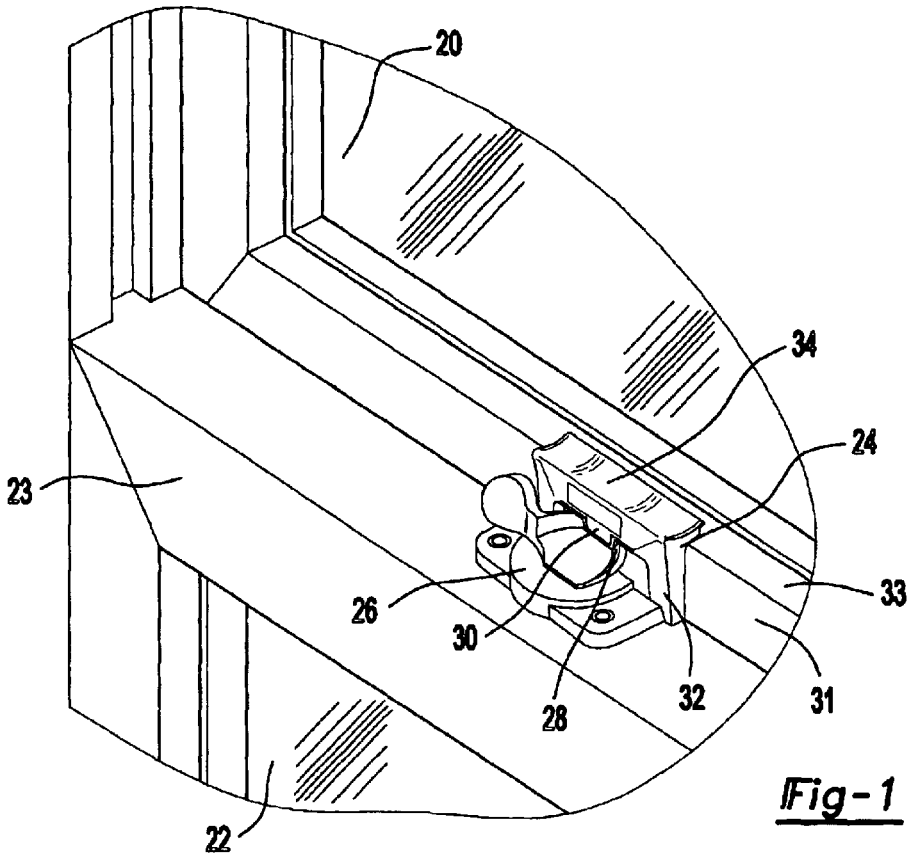
FIG. 1 shows a double hung window incorporating the present invention in a "locked" position.

As shown in FIG. 1, a double hung window includes an upper pane 20 and a lower pane 22. Lower pane 22 includes a top frame member 23 supporting a pivoting latch 26. As is known, pivoting latch 26 has a latching cupped member 28 that is caught underneath a keeper tongue 30 on a combined keeper/force-applying surface 24. As shown, the combined keeper/surface 24 incorporates a force-applying surface 34 at a vertically upward facing portion. As can be appreciated, the surface 34 sits atop an uppermost edge 33 of the frame of the upper pane. A side wall 32 of the combined keeper/surface 24 extends along a forward face 31 of that same frame member.

Figure 2:
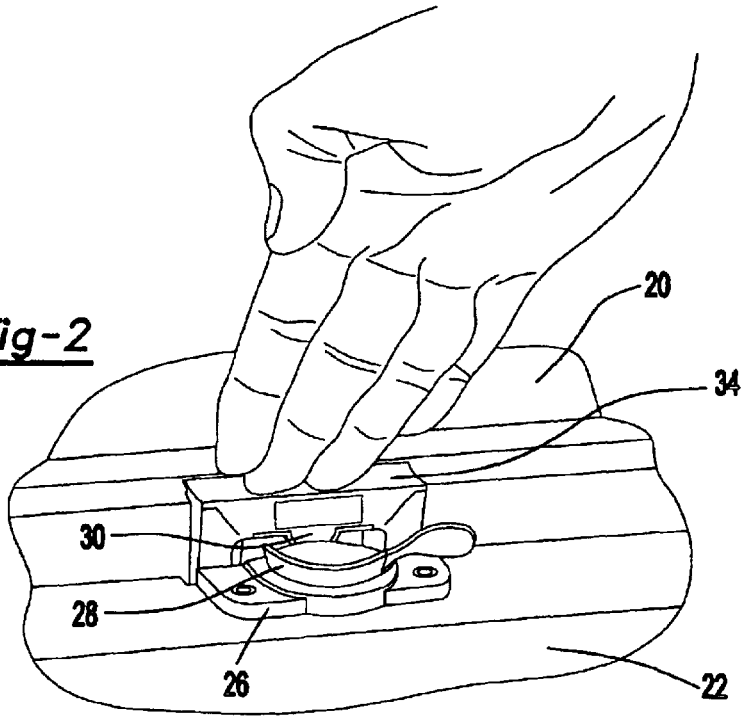
FIG. 2 shows the double hung window of FIG. 1 with the latch having been pivoted to the "open" position.

As shown in FIG. 2, and as generally known, the pivot 26 can have member 28 pivoted such that member 28 is no longer caught underneath tongue 30. In this position, the two panes 20 and 22 may now be moved relative to each other to vertically adjusted positions. As shown, a user may apply a downward force to surface 34.

Figure 3A:
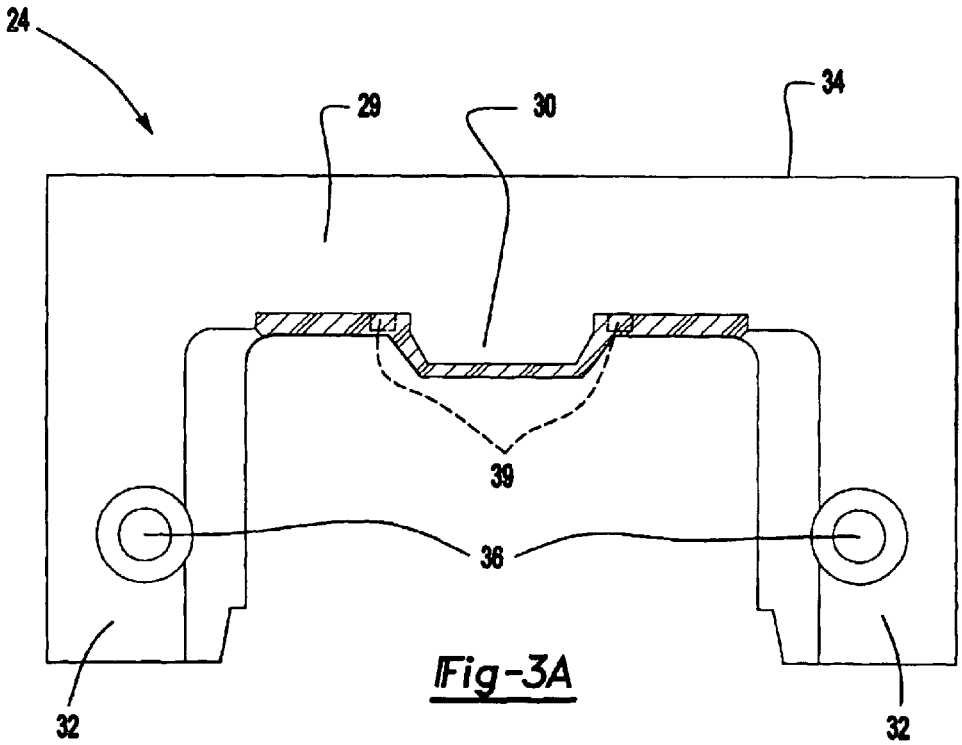
FIG. 3A is a front view of the combined keeper/surface member.

FIG. 3A shows the combined keeper/surface 24. As can be appreciated, side walls 32 extend downwardly from the upper surface 34. A plastic surface 37 is secured to the keeper 30 and along an inner side of the upper surface 34. As shown, pins 39 may secure the plastic to a central web 29 which provides the surface 34 on an opposed side. As also shown, bolts 36 allow the combined keeper/surface 24 to be secured to the frame face 31.

Figure 3B:
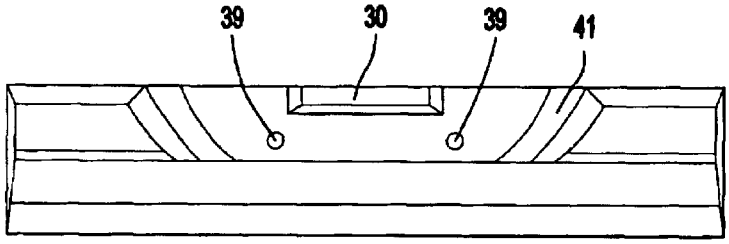
FIG. 3B is an inside view of the combined keeper/surface member.

As shown in FIG. 3B, there is a curved inner surface 41 surrounding the tongue 30, and the pins 39 are inward of that surface 41. The surface 41 allows the pivoting movement of the member 28 of the latch 26. As can be appreciated from FIG. 3B, the tongue 30 extends for a distance that is less than half, and preferably less than one-third the distance over which the force-applying surface 34 extends.

Figure 4:
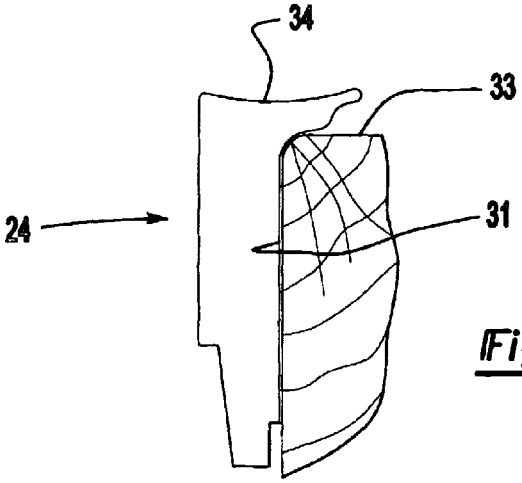
FIG. 4 is a side view of the combined keeper/surface as attached to an upper pane of a window.

As shown in FIG. 4, the frame surfaces 31 and 33 accommodate the shape of the combined keeper/surface 24. As can be appreciated, the surface 34 is curved along a slight radius to provide a finger recess. As can be appreciated, the curvature of the surface 34 is along a slight radius relative to an axis extending generally parallel to the plane of the window in the upper pane. As can be appreciated from FIG. 1 taken with FIG. 4, the downwardly extending legs 32 and the tongue 30 extend in a first direction away from a central body or web, and the surface 34 faces an opposed direction. Moreover, as can be appreciated, the surface 34 extends generally perpendicular to the legs, and beyond a width of the legs such that the combined keener/surface 24 can fit around a frame member 33, such as can be seen in FIG. 4.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A double hung window comprising:

an upper pane and a lower pane, said lower pane including a pivoting latch member, and said upper pane including a keeper, said keeper having a tongue for selectively receiving said pivoting latch member to prevent vertical movement between said upper and lower pane, said pivoting latch member being movable to an open position at which said upper and lower panes may move relative to each other; and said keeper including a force-applying surface providing a generally elongate surface having a slight radius of curvature for providing a downward force to said upper pane, said generally elongate surface being attached to said keeper, said force-applying surface being spaced in an upward direction relative to said tongue, such that said tongue is spaced toward said lower pane from said force-applying surface, said tongue extending along a first distance, and said force-applying surface extending along a second distance, with said second distance being more than twice said first distance.

2. A double hung window as set forth in claim 1, wherein said force-applying surface and said tongue are integrally formed.

3. A double hung window as set forth in claim 2, wherein said keeper and said force-applying surface are provided by a generally u-shaped member, with said generally u-shaped member having downwardly extending legs and a central web, said tongue and said force-applying surface being provided along said central web.

4. A double hung window as set forth in claim 3, wherein said central web and said force-applying surface extending generally perpendicular to a downward extending direction of said legs, and said web extending in said perpendicular direction for a distance that is greater than a thickness of said legs in said perpendicular direction, such that said web can fit onto a frame portion of said upper pane with said force-applying surface facing upwardly.

5. A double hung window as set forth in claim 1, wherein said elongate surface is curved along a radius such that an axis of said radius extends generally parallel to a surface of glass in said upper pane of said double hung window.

6. A double hung window as set forth in claim 1, wherein an entirety of said tongue is vertically below the entirety of said force-applying surface.

7. A keeper for use in a double hung window comprising:

a generally U-shaped member having a pair of downwardly extending legs connected by a central web, said central web having an inwardly facing surface with a tongue for receiving a latch from a latch mechanism associated with a pane on a window; and said central web having an upwardly facing force-applying surface with a slight radius of a curvature for receiving a downward force to move a window pane receiving said keeper in a vertical direction, said central web and said force-applying surface extending across said tongue, such that said tongue extends in a first direction from said web, and said force-applying surface faces in a second direction from said central web, with said force-applying surface extending beyond and across a portion of said central web from which said tongue extends.

8. A keeper as set forth in claim 7, wherein said central web and said force-applying surface extending generally perpendicular to a downward extending direction of said legs, and said web extending in said perpendicular direction for a distance that is greater than a thickness of said legs in said perpendicular direction, such that said web can fit onto a frame portion of an upper window pane with said force-applying surface facing upwardly.

9. A keeper for use in a double hung window comprising:

a body having a tongue for receiving a latch from a latch mechanism associated with a pane on a window;

an elongate force-applying surface having a slight radius of curvature for providing a downward force to said tongue and a pane receiving said keeper, said tongue extending from said body in a first direction, and said elongate force-applying surface facing from said body in a second direction, said elongate force-applying surface extending along a length of said body which extends on both sides or a portion of said body from which said tongue extends, and which crosses said portion of said body; and said keeper including a central web and a pair of spaced legs, and said force-applying surface extending generally perpendicular to a downward extending direction of said legs, and said web extending in said perpendicular direction for a distance that is greater than a thickness of said legs in said perpendicular direction, such that said web can fit onto a frame portion of an upper window pane with said force-applying surface facing upwardly.

10. A keeper as recited in claim 9, wherein said force-applying surface and said tongue are integrally formed as a single part.

* * * * *